US006447399B1

(12) United States Patent
Denham

(10) Patent No.: US 6,447,399 B1
(45) Date of Patent: Sep. 10, 2002

(54) METHOD OF FORMING A TUBULAR MEMBER

(75) Inventor: Keith Denham, Welwyn Garden City (GB)

(73) Assignee: Textron Fastening Systems Limited (GB)

( * ) Notice: Subject to any disclaimer, the term of this patent is extended or adjusted under 35 U.S.C. 154(b) by 0 days.

(21) Appl. No.: 09/700,086

(22) PCT Filed: Jun. 4, 1999

(86) PCT No.: PCT/GB99/01776

§ 371 (c)(1),
(2), (4) Date: Dec. 20, 2000

(87) PCT Pub. No.: WO99/64751

PCT Pub. Date: Dec. 16, 1999

(30) Foreign Application Priority Data

Jun. 5, 1998 (GB) ..... 9812093

(51) Int. Cl.[7] ..... B21K 1/44

(52) U.S. Cl. ..... 470/29; 470/28; 470/31; 72/358; 72/370.06

(58) Field of Search ..... 470/28, 29, 30, 470/31, 33; 72/352, 358, 359, 370.03, 370.06, 370.08, 370.1

(56) References Cited

U.S. PATENT DOCUMENTS

| | | | | | |
|---|---|---|---|---|---|
| 2,843,861 | A | * | 7/1958 | Gandy | 470/29 |
| 3,009,177 | A | * | 11/1961 | Carusi et al. | 470/29 |
| 3,114,921 | A | * | 12/1963 | Carusi | 470/30 |
| 3,247,698 | A | * | 4/1966 | Baldwin et al. | 72/370.03 |
| 3,292,414 | A | * | 12/1966 | Goeke | 72/370.1 |
| 3,638,259 | A | * | 2/1972 | Eibes | 470/29 |
| 4,520,521 | A | * | 6/1985 | Miyake | 470/29 |
| 4,580,936 | A | | 4/1986 | Francis et al. | |
| 4,708,553 | A | | 11/1987 | Braychak et al. | |

FOREIGN PATENT DOCUMENTS

| | | |
|---|---|---|
| EP | 0162647 | 11/1985 |
| EP | 0328314 | 8/1989 |
| EP | 0631831 | 1/1995 |

* cited by examiner

*Primary Examiner*—Ed Tolan
(74) *Attorney, Agent, or Firm*—Trexler, Bushnell, Giangiorgi, Blackstone & Marr, Ltd.

(57) ABSTRACT

A method of forming a tubular member with longitudinal slots along part of its wall, comprising the steps of: firstly, forming longitudinal zones of weakness along part of the wall of the tubular member, and secondly, expanding the said part of the tubular member radially to cause fracture of the wall of the member along the longitudinal zones, thereby to form longitudinal slots.

16 Claims, 5 Drawing Sheets

Fg.1b

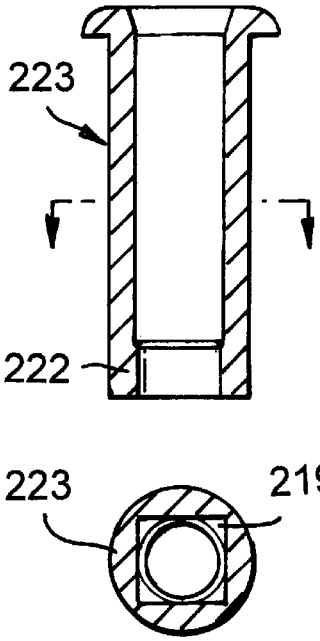
Fig.3d
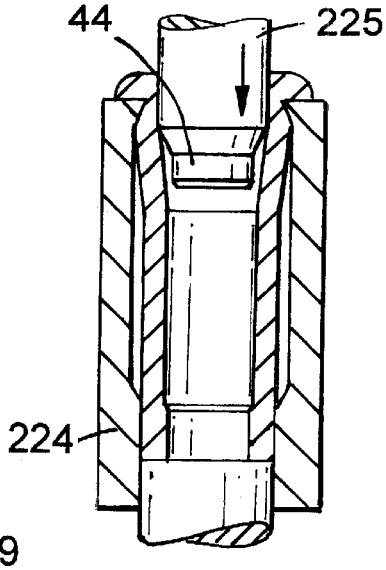
Fig.3e
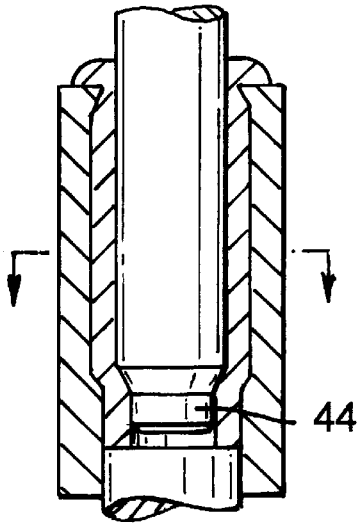
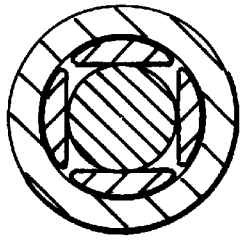
Fig.3f
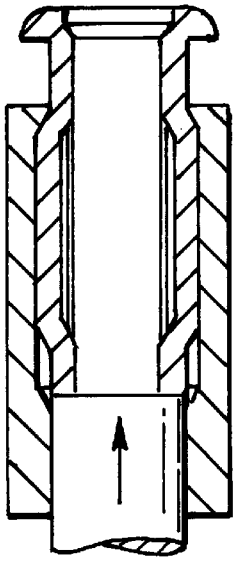
Fig.3g
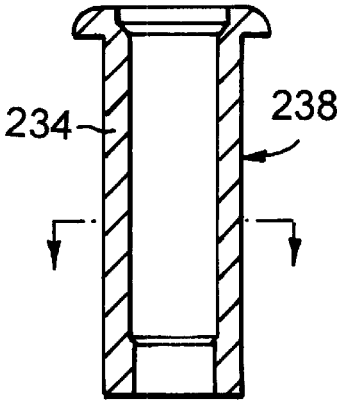
Fig.3h
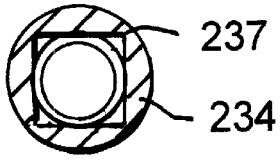

METHOD OF FORMING A TUBULAR MEMBER

This application is a 35 USC 371 of PCT/GB99/01776 filed Jun. 4, 1999.

The invention relates to a method of forming a tubular member with longitudinal slots in its wall. By way of example, one such tubular member is the tubular shell of a blind breakstem rivet, of the type which is provided with multiple longitudinal slots so that, when the rivet is set by axially compressing part of the shell, the shell deforms into a number of outwardly projecting legs which provide a blind head having a relatively large radial dimension of engagement with the workpiece. Examples of such blind rivets with slotted shells are commercially available under the Registered Trade Marks BULBEX and TLR. However such longitudinally slotted members can be used for many other purposes.

The term 'slot' is intended to include both constructions in which there is a gap between the edges or walls of the parts of the material of the tubular member separated by the slot, and also constructions in which the two edges or walls of the slot are in contact with each other, there being a mechanical discontinuity in the material.

Such slotted members are usually of metal. With a relatively soft metal, such as aluminium, forming the slots in a tubular blank is commonly done by driving through the bore of the blank a close-fitting tool of much harder material, such as steel, which carries a number of radially projecting longitudinal ribs, each having a radial height equal to at least the wall thickness of the tubular blank. Each rib forms a corresponding longitudinal slot in the blank. However, if this method is applied to tubular blanks of steel, it is found that rapid and excessive wear to the tool, particularly to the leading ends of the ribs, occurs.

The present invention aims to provide a new method of forming a tubular member with longitudinal slots in its wall, which overcomes this problem.

Accordingly, the present invention provides, in one of its aspects, a method of forming a tubular member with slots along part of its wall, which method is set out in the accompanying claim 1.

Further features of the invention are set out in the accompanying claims 2 to 16. The invention includes a tubular member which has been formed by a method according to the invention, as set out in claim 16.

Figure 4:
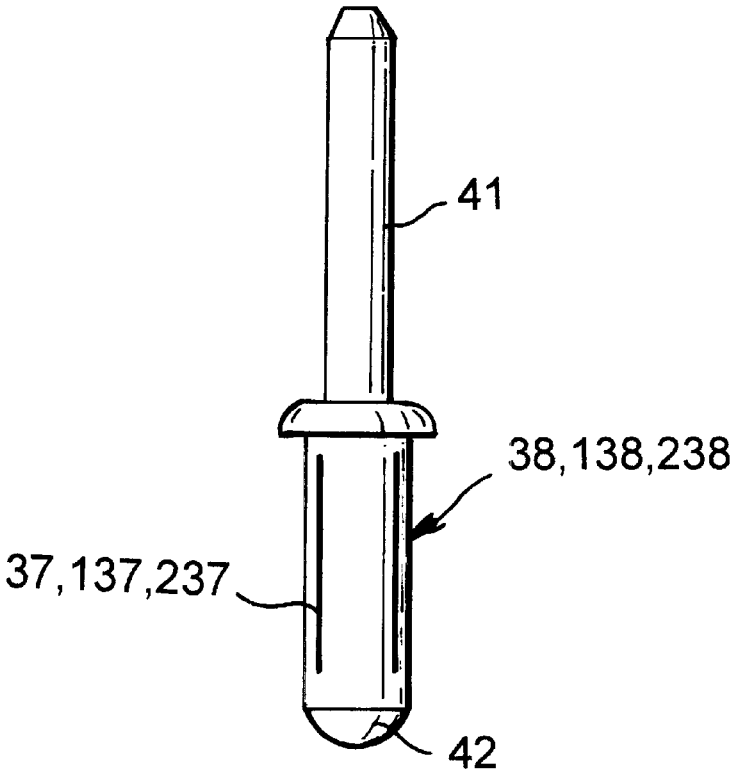
Figure 5A:
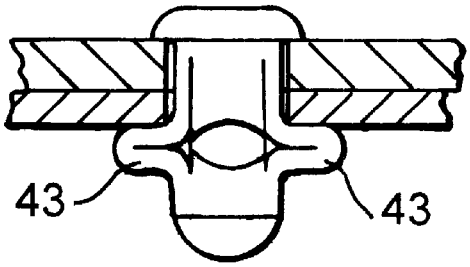
Figure 5B:
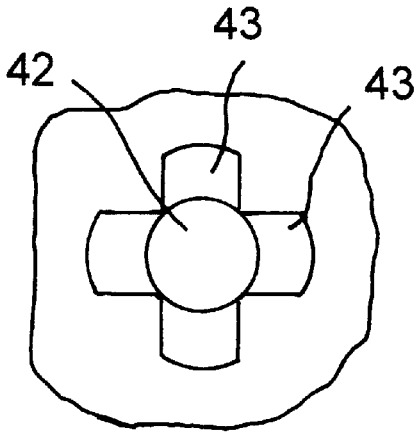

Some specific examples of the invention will now be described by way of example and with reference to the accompanying drawings, in which:

FIGS. 1*a* to 1*i* show successive configurations of a blank during one example method;

FIGS. 2*d* to 2*h* correspond to FIGS. 1*d* to 1*h* respectively and illustrate a second example method which is a modification of the first example;

FIGS. 3*d* to 3*h* correspond to FIGS. 1*d* to 1*h* respectively and illustrate a third example method which is a different modification of the first example;

FIG. 4 illustrates a blind rivet assembly incorporating a tubular shell made according to the invention; and FIGS. 5*a* and 5*b* show the rivet of FIG. 4 in the placed condition.

The term 'blank' is used to refer to the tubular member in all these successive configurations, apart from the finished product.

In FIGS. 1, 2 and 3 the blank is shown at least in longitudinal axial section, and in some Figures in cross-section as well, the cross-section being taken on the arrowed section line on the longitudinal section. In some Figures, the die in which the blank is contained, and a punch and/or ejector, is also shown.

In the examples, the blank is typically of low carbon steel and is designed to be used in the manufacture of a rivet shell of about 5 mm external diameter. Punches and dies used in the manufacturing processes are made of tool steel. The manufacturing methods are performed using a progressive cold-heading machine, of the type commonly used to make such rivet shells and other items, and well known and understood by those skilled in the art.

Figure 1C:
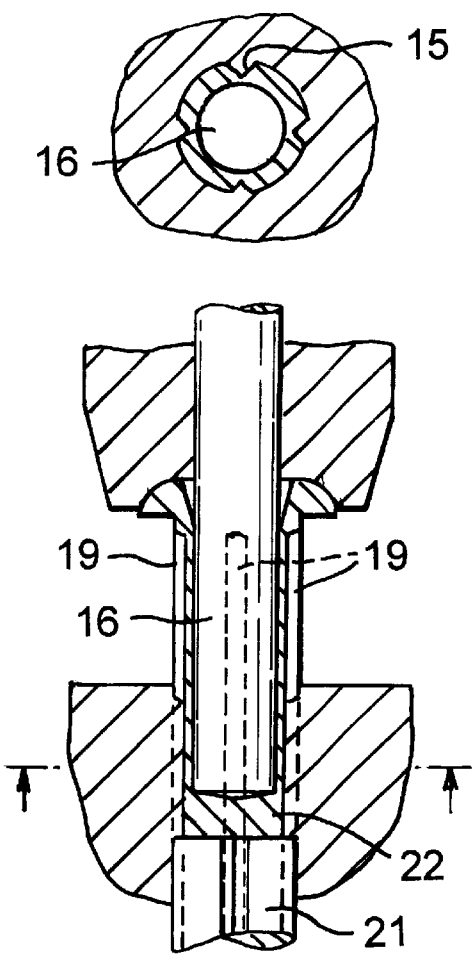
Figure 1A:
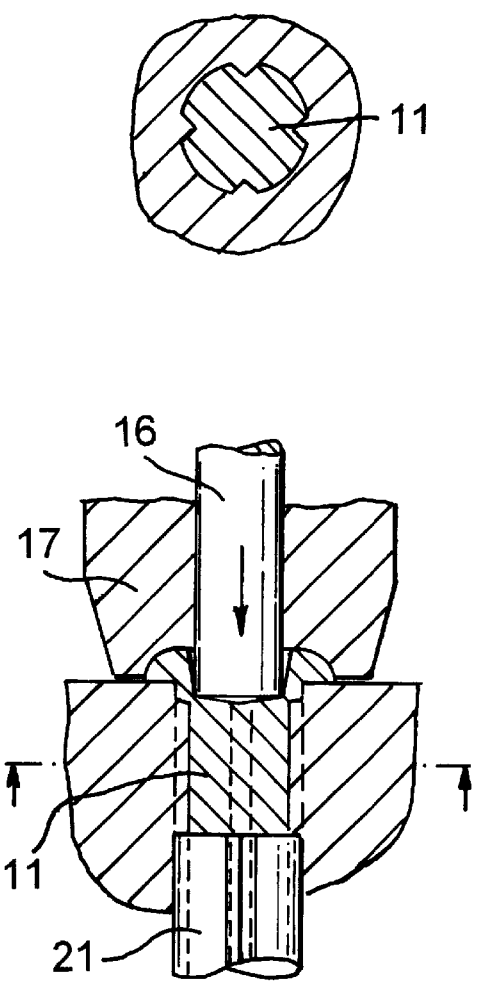
Figure 1A:
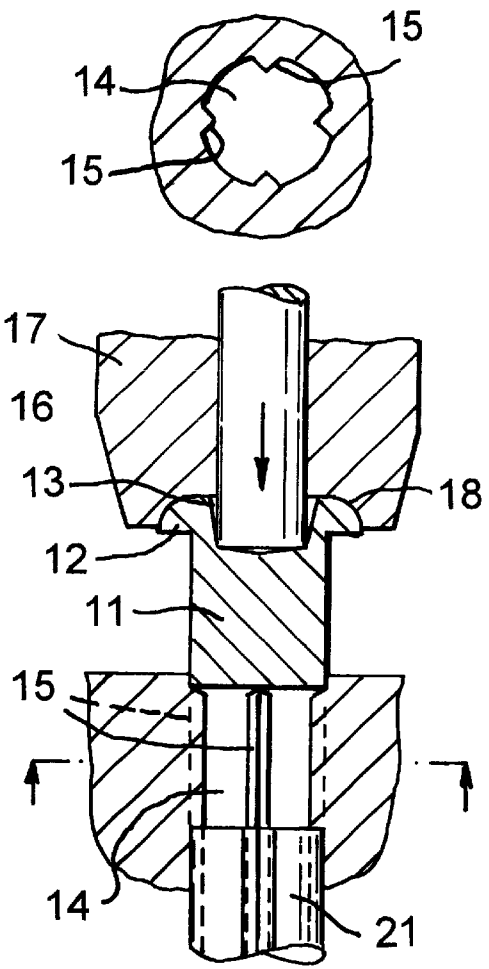

Thus, referring first to FIG. 1*a,* a blank 11 has been formed from a cylindrical slug cut from wire and has been formed with a head 12 and a tapering axial depression 13 at the head end. It is offered up to a die 14 which has a cylindrical in shape with four longitudinal ribs 15 spaced at 90° apart around the die. As illustrated in FIG. 1*a,* the ribs are triangular in section with an included apex angle of 90° and a fairly sharp crest.

Figure 1D:
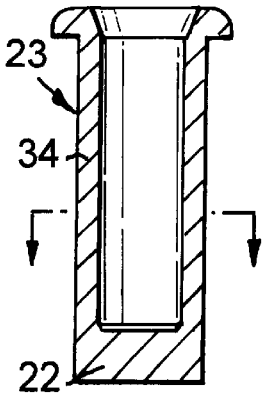
Figure 1D:
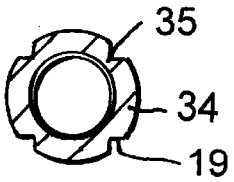

A punch is then driven into the depression 13 of the blank. The punch 16 is co-axial with a spring-loaded tool 17 which has an annular recess 18 on its leading end, to fit around the head of the blank. The punch and tool drive the blank into the die, as shown in FIG. 1*b,* until the leading end of the blank contacts the bottom of the die (which is provided by the end face of an ejector pin 21), and the underside of the head of the blank contacts the face of the die. As illustrated in FIGS. 1*b* and 1*c* the diameter of the punch 16 is rather less than the diametrical distance between opposed crests of ribs 15. Continued movement of the punch 16 into the die 14 causes backwards extrusion of the material of the blank upwardly around the punch 16, the co-axial tool 17 rising against its spring-loading. The ribs 15 in the die 14 have formed longitudinal grooves 19 in the exterior face of the rearwardly extruded blank, as shown in FIG. 1*c*. These grooves extend from near the underhead face of the blank to the remote end of the blank. The punch 16 is driven into the die only far enough that its leading end is spaced from the end wall of the die by a distance which leaves a thick web 22 at the end of the blank, as shown in FIGS. 1*c* and 1*d*.

Figure 1E:
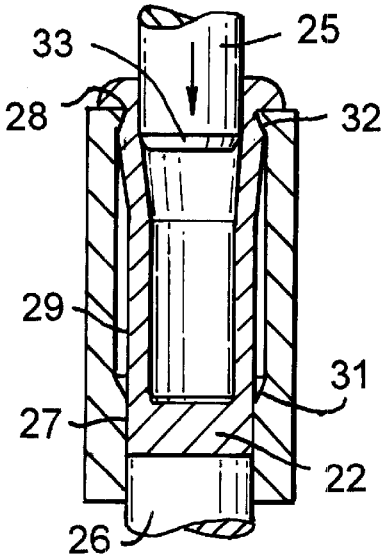

The punch 16 and tool 17 are now withdrawn and the blank ejected from the die by the ejector 21. The blank is in the form shown in FIG. 1*d,* and will now be referred to by the numeral 23. Most of the length of the blank comprises four full-thickness longitudinal zones 34, joined each to the next by a thin longitudinal web 35, indicated in FIG. 1*d*. The blank 23 is now inserted in the next die 24, as shown in FIG. 1*e* (which also shows a punch 25 entering the blank 23). The die 24 has its lower end provided by the top face of an ejector pin 26. The inner end portion 27 of the die, adjacent the ejector 26, and the outer end portion 28 of the die 24, are of appropriate diameter to fit the exterior diameter of the blank 23. However, a lengthy intermediate portion 29 of the die is of larger diameter than the blank 23. This enlarged portion 29 merges to each of the smaller diameter end portions 27, 28 by a tapering portion 31, 32.

Figure 1F:
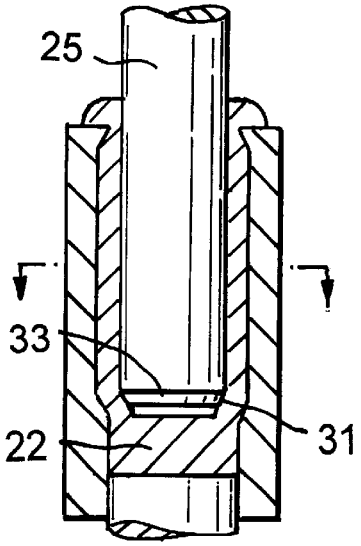
Figure 1F:
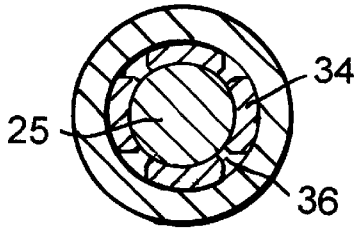

When the blank 23 has been fully inserted into the die 24 so that its bottom end contacts the ejector pin 26 and its underhead surface abuts the outer face of the die, the web 22 of the blank is contained within the inner end portion 27 of the die which is of a reduced diameter. A cylindrical punch 25 is driven into the blank. FIG. 1*e* illustrates the start of this process. The punch has a main diameter greater than that of the bore of the blank 23, and has a chamfered leading edge 33 to facilitate its entry into the blank's bore. As the punch 25 progressively enters the die, it radially expands the blank 23. This has the effect of bursting apart the four full-thickness longitudinal zones 34 by breaking the four thin webs 35, at least over the majority of their lengths, to give four gaps 36 shown in FIG. 1*f*. The material in the thin webs 35 is work hardened to a much greater extent than the other parts of the blank. This, together with the stress concentration in the webs, assists in their breaking. FIG. 1*f* shows the fullest penetration of the punch 25 into the blank. The bottom end face of the punch is opposite the lower tapering portion 31 of the die, and is spaced slightly apart from the web portion 22 of the blank. The gaps do not extend to the web portion at the end of the blank. The ends of each gap 36 taper in width due to the effect of the tapering portions 31, 32 of the die.

Figure 1G:
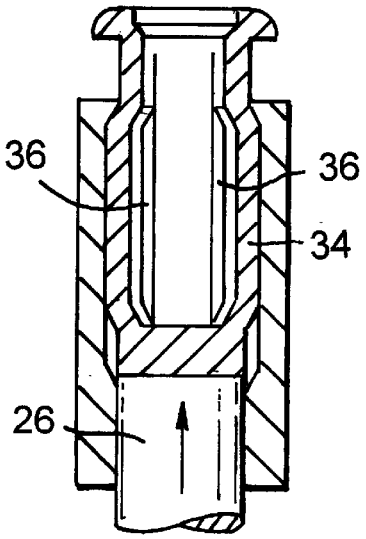
Figure 1H:
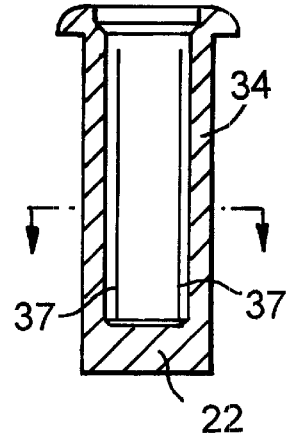
Figure 1H:
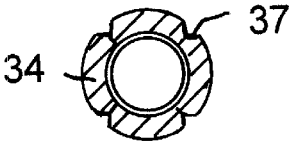

The punch 25 is now withdrawn, and the ejector pin 26 is actuated to force the blank back out of the die 24. FIG. 1*g* shows an intermediate stage in this action. As the major part of the blank, in the form of the four longitudinal zones 34, is pushed through and past the tapered portion 32 and the reduced diameter outer portion 28 of the die, the four zones 34 are forced radially inwards, thus closing up the four longitudinal gaps 36. FIG. 1*h* shows the form of the blank after this process has been completed. The edges of each adjacent pair of longitudinal zones 34 are in contact with each other adjacent the inner wall of the tubular member, with a slot 37 of effectively zero thickness (i.e. a physical discontinuity) between them, and a groove down the outside of the member.

Figure 1I:
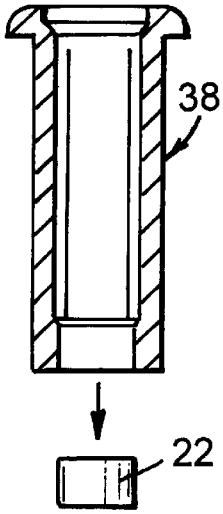

The blank in the form shown in FIG. 1*h* is then inserted in another die (not shown) where the web portion 22 at the end of the blank is removed by a suitable tool (not shown), as indicated schematically in FIG. 1*i*. This leaves the fully manufactured tubular slotted member as illustrated at 38 in FIG. 1*i*.

The man skilled in the art of progressive cold-heading will appreciate that, allowing for two dies to head and form the depression in the initial blank 11 in FIG. 1*a*, the two dies 14 and 24, and the further die for removing the end web, this example manufacturing process can be carried out on a 5-station progressive cold header.

FIG. 2 illustrates a modification of the example method described with reference to FIG. 1. In FIG. 2, FIGS. 2*d* to 2*h* respectively correspond to FIGS. 1*d* to 1*h*. For ease of comparison and understanding, identical parts are indicated by identical reference numerals, and corresponding parts are indicated by similar reference numerals with 100 added to the number.

Figure 2E:
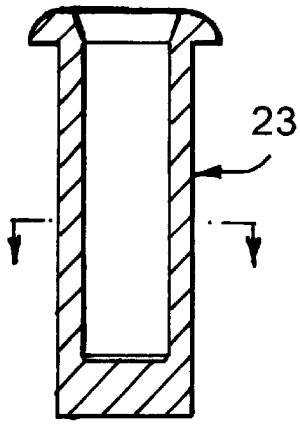
Figure 2E:
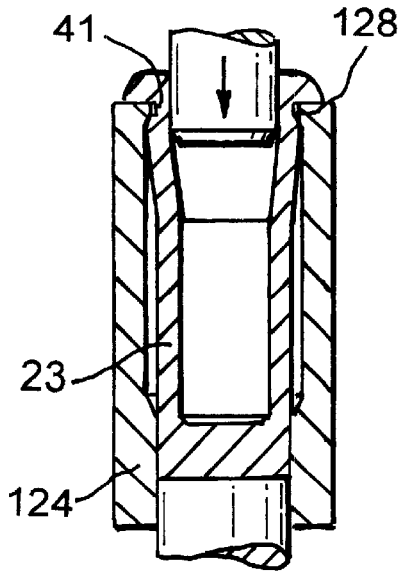
Figure 2E:
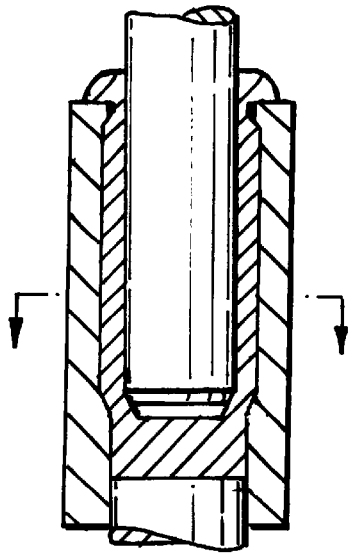
Figure 2D:
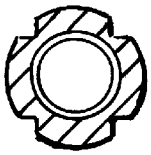
Figure 2F:
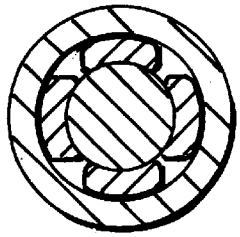
Figure 2G:
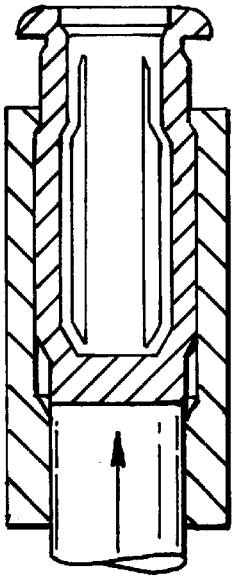
Figure 2H:
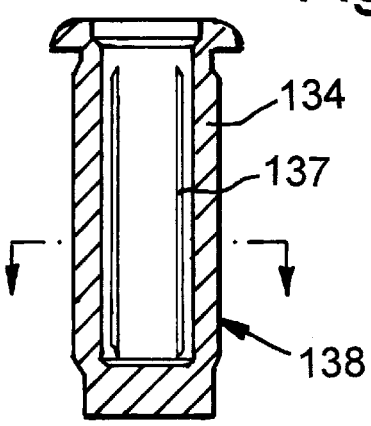
Figure 2H:
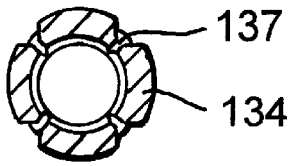

The only difference of substance in this modification is that the die 124 has a slightly larger diameter mouth. This is apparent from FIGS. 2*e* & 2*f*, which show an annular gap 41 between the blank 23 and the outer portion 128 of the die adjacent its mouth. The effect of this is that, when the blank is ejected, its radially enlarged part is reduced to a diameter slightly larger than its original size. Consequently, the four longitudinal parts 134 are not in edge-to-edge contact with each other, but are separated by narrow gaps 137, as shown in FIG. 2*h*.

A further example is illustrated in FIGS. 3*d* to 3*h*, which also correspond respectively to FIGS. 1*d* to 1*h*. Again, identical parts are given identical reference numerals, and corresponding parts by similar reference numerals with 200 added. This is also a modification of that first example method, but is a greater modification than the one just described.

In this example, the tubular blank 223 before radial expansion has, effectively, four equally spaced longitudinal grooves 219 along its inner face. The bore of the blank is in fact square in section as illustrated in FIG. 3*d*. This is achieved by using a die and punch which are a modification of those illustrated in FIG. 1. The die will be cylindrical in section, and the punch square in section. The man skilled in the art of cold forming will readily understand how to design such a die and punch, which are the inverse of those of FIG. 1. The other difference is that the blank made in this form has a bore extending completely through it, with no web across the end, although the corresponding tail end portion may be thickened as at 222 in FIG. 3*d*.

The radial expansion of the blank is by means of a die 224 and punch 225. The punch 225 has its end part 44 of reduced diameter, which fits inside the far end part of the blank bore where, in FIGS. 1 & 2, the web portion 22 was. This radial expansion of the blank, and its subsequent reduction in diameter on ejection from the die, are substantially identical to those described in the first example method with reference to FIG. 1. The only substantial difference in the finished manufactured tubular member 238 is that it has its four longitudinal parts 234 separated by longitudinal internal grooves each of which leads to a zero-thickness slot 237 adjacent the outside of the tubular member. There is no web at the end of the tubular member to be removed. Thus this manufacturing process can be carried out on a 4-station header.

FIG. 4 illustrates how a tubular member such as 38, 138 or 238 is used in a blind rivet, assembled on a stem 41 having a stem head 42. When the rivet is placed, by axially compressing the shell 38, 138 or 238, the shell parts at the four slots 37, 137 or 237, to form four outwardly folded legs 43, as shown in FIG. 5.

The configuration of the tubular member 138 illustrated in FIG. 2*h* is particularly advantageous for use as a blind rivet shell. The fact that an intermediate length of the shell has its outer surface radially outwardly offset with respect to its ends promotes initial buckling of the shell under axial compression.

The invention is not restricted to the details of the foregoing examples. A slotted tubular member may be utilised for any convenient purpose, other than a blind rivet shell.

A combination of both internal and external grooves could be used.

What is claimed is:

1. A method of forming a tubular member with longitudinal slots along part of its wall, comprising the steps of:

firstly, forming longitudinal zones of weakness along part of the wall of the tubular member, each comprising a longitudinal zone of reduced wall thickness;

secondly, expanding the said part of the tubular member radially to cause fracture of the wall of the member along the longitudinal zones, thereby to form longitudinal slots, each bounded by opposed edges or walls; and thirdly, radially compressing at least the said part of the tubular member so that the edges or walls of at least part of each slot move nearer each other.

2. A method as claimed in claimed in claim 1, in which the third step comprises radially compressing the tubular member until the edges or walls of at least part of the length of each slot are in contact with each other.

3. A method as claimed in claim 1, in which the third step comprises compressing the tubular member so that edges or walls of at least part of each slot move nearer to each other but do not contact each other.

4. A method as claimed in claim 1, in which radial expansion of the tubular member is achieved by driving axially into its bore a pin of larger diameter than the bore.

5. A method as claimed in claim 1, in which radial expansion of the tubular member is achieved by locating it within a die cavity having part of its length, corresponding to the aforesaid part of the tubular member, of a diameter corresponding to the desired enlarged diameter of the tubular member, and driving axially into the bore of the tubular member a pin of larger diameter than the bore, and in which the die is provided with at least one other part of its length of reduced diameter.

6. A method as claimed in claim 5, in which radial compression of the thus radially expanded tubular member is achieved by axially forcing the expanded part of the tubular member through a part of the die of reduced diameter.

7. A method as claimed in claim 1, in which the longitudinal zones of weakness are provided by longitudinal grooves along the inner surface of the wall of the tubular member.

8. A method as claimed in claim 1, in which the longitudinal zones of weakness are provided by longitudinal grooves along the outer surface of the wall of the tubular member.

9. A method as claimed in claim 1, in which the longitudinal zones of weakness are provided by longitudinal grooves along the inner surface, and longitudinal grooves along the outer surface, of the tubular member.

10. A method as claimed in claim 7 or claim 8, in which the forming of the aforesaid longitudinal grooves takes place in the same operation as the forming of the bore of the tubular member.

11. A method as claimed in claim 10, in which the forming of the grooves is achieved by backwards extrusion.

12. A method as claimed in claim 9, in which the forming of the aforesaid longitudinal grooves takes place in the same operation as the forming of the bore of the tubular member.

13. A method as claimed in claim 12, in which the forming of the grooves is achieved by backwards extrusion.

14. A method as claimed in claim 1, in which the tubular member is initially formed with its bore stopping short of one end of the member, the bore being opened at that end of the member in a subsequent operation.

15. A method as claimed in claim 1, in which the tubular member is initially formed with its bore extending completely throughout its length.

16. A tubular member with longitudinal slots along part of its wall which has been formed by forming longitudinal zones of weakness along part of the wall of the tubular member, each comprising a longitudinal zone of reduced wall thickness, and expanding the said part of the tubular member radially to cause fracture of the wall of the member along the longitudinal zones, thereby to form longitudinal slots.

* * * * *